US007709173B2

(12) United States Patent
Ohmura et al.

(10) Patent No.: US 7,709,173 B2
(45) Date of Patent: May 4, 2010

(54) TONER

(75) Inventors: Ken Ohmura, Hachioji (JP); Hiroshi Yamazaki, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 368 days.

(21) Appl. No.: 11/881,450

(22) Filed: Jul. 27, 2007

(65) Prior Publication Data

US 2008/0050669 A1 Feb. 28, 2008

(30) Foreign Application Priority Data

Aug. 28, 2006 (JP) ..... 2006-230551

(51) Int. Cl.
*G03G 9/087* (2006.01)

(52) U.S. Cl. ..... 430/109.4

(58) Field of Classification Search ..... 439/109.4
See application file for complete search history.

(56) References Cited

U.S. PATENT DOCUMENTS

| | | | | |
|---|---|---|---|---|
| 4,940,644 | A * | 7/1990 | Matsubara et al. | 430/109.4 |
| 2005/0042534 | A1 * | 2/2005 | Tanaka et al. | 430/108.4 |

FOREIGN PATENT DOCUMENTS

| | | |
|---|---|---|
| JP | 05045929 | 2/1993 |
| JP | 5-44027 | 7/1993 |
| JP | 2006018018 | 1/2006 |

* cited by examiner

*Primary Examiner*—Janis L Dote
(74) *Attorney, Agent, or Firm*—Cantor Colburn LLP

(57) ABSTRACT

A toner comprising a binder resin and a colorant, wherein the binder resin comprises an urea modified polyester, the urea modified polyester being prepared by urea-bonding an isocyanate-modified crystalline polyester segment and an isocyanate-modified amorphous polyester using an amine crosslinking agent.

10 Claims, No Drawings

TONER

This application is based on Japanese Patent Application No. 2006-230551 filed on Aug. 28, 2006 in Japanese Patent Office, the entire content of which is hereby incorporated by reference.

FIELD OF THE INVENTION

The present invention relates to a toner to be used for an image forming method by electrophotographic system.

BACKGROUND OF THE INVENTION

Recently, electrophotographic image forming apparatus such as printers, facsimile machines or multifunctional peripheral (MFP) improved in energy saving are required for global environmental protection, and development of MFP reduced in electric cost has been progressed.

It is essential for reducing electric cost to attain low temperature fixing in the fixing apparatus consuming large electric power. Also, airtightness of the image forming apparatus and the toner cartridge has to be improved since small sizing of the apparatus and maintaining suitability are necessary. The toner to be used in such the apparatus is desired that the toner particles are not thermally coagulated by accumulating caused by the fixing treatment. Concretely, it is essential that the toner particles are not thermally coagulated and have stable fluidity and superior heat resistive storing ability in a magnetic single-component or non-magnetic single-component toner cartridge or a double-component developer type developing unit in which a developing roll and a magnetic carrier are enclosed.

On the other hand, the electrophotographic image forming method is spread from simple use for copying documents in an office by a usual copying machine to a printer to uses out of the office. Specifically, application of the electrophotographic image forming system expands to the market of on-demand printing (POD) included in the area of light printing. On the POD market, need of printing on recording materials other than usually used image recording material such as paper in the electrophotographic system become strong.

The paper suitable for the electrophotographic image formation is generally designed to be suitable for the image forming apparatus, namely suitable for the toner used in the apparatus, where the surface resistivity of the paper is increased to increase the transferring efficiency, or a filler having small particle diameter or having low damage causing property is applied to reduce the damage on the photoreceptor. However, it is required in the field of POD that the tone can be suitable for various kinds of paper.

Concrete examples of the various kinds of paper include a cardboard to be used for a cover of booklet, an advertisement poster, a glossy paper to be used for a printed matter having high quality feeling and a coated paper to be used as a stout card on which wax or polylactic acid latex was coated. Moreover, in the field of POD, there is a case in which a coated paper is used as the printing paper and then laminate treated after printing to increase the glossiness of the whole of the printed matter.

Various problems occurs, however, on the occasion of printing using the usual toner onto the above described kinds of paper. For example, a problem such as that the toner is peeled off from the coated paper because the toner is not sufficiently permeated into the coated paper so that the fixing is insufficiently performed when the usual toner is printed and fixed on the coated paper, and that the toner is peeled off from the laminating material when the paper is subjected to the lamination treatment because sufficient contact between the toner and the laminating material cannot be obtained. Therefore, sufficiently fixed visible image is difficultly to be formed when the printing is performed onto the above-described kinds of paper by using the usual toner.

It has been known to use a graft-copolymer or a block-copolymer of crystalline polyester and amorphous polyester as a binder resin constituting the toner for attaining low temperature fixing in the fixing apparatus. It has been found that the low temperature fixing ability can be obtained by high melting ability of the crystalline polyester and by high viscoelasticity of the amorphous polyester when an image is printed using such the toner on the above-described paper such as the coated paper.

However, the binder resin formed by simply graft-copolymerizing or block-copolymerizing the crystalline polyester and the amorphous polyester results in having a usual polyester structure and is negatively charged. Therefore, there have been problems, for example, that, when such a binder resin is used in a toner, the amount of charge is unintentionally increased, or that only insufficient adhesion of the toner to the coated paper is obtained due to repulsion force of the charge when printed on a paper coated with polylactic acid. As the result, the toner tends to peel off at the interface of the coated paper and the toner with a strong impact, when the image printed on the coated paper is subjected to a laminating treatment. It can be considered as the reason of the peeling off of the toner from the polylactic acid coated paper that, not only due to the electrostatic repulsion force between the coating material and the toner, sufficient adhesion cannot be obtained when the toner does not have a high melting performance in the case of the fixing of the toner by thermally melting the binder resin, because the coating material of the coated paper is not melted to deform as a usual paper sheet so that the anchor effect cannot be obtained. In the case of the ink, suitable fixation can be obtained because the ink is permeable into the coated paper.

As above-described, the toner using the binder resin formed by simply graft-copolymerizing or block-copolymerizing the crystalline polyester and the amorphous polyester does not exhibit sufficient toner strength even though sufficient low temperature fixing ability can be obtained.

The crystalline polyester easily causes filming on triboelectricity generating parts such as the developing roller, the carrier and the image carrier when the binder resin composed of the crystalline polyester becomes exposed from the toner particle by crashing the toner particle since the crystalline polyester has malleability. When the filming is caused on the image carrier, a problem is posed that the filming resin absorbs moisture and causes irregular image such as image streaming at the starting of the image forming apparatus.

For solving the problem of filming, a technology is proposed, in which the crystalline polyester is graft-copolymerized as a branched chain with a principal chain of another resin, cf. Patent Documents 1 to 3, for example. However, the problem of filming is not sufficiently solved yet by such the technology.

Reason of that is surmised that the resin is not sufficiently grafted because the graft-copolymerization is performed by applying the dehydration reaction on the occasion of synthesizing the polyester.

Patent Document 1: Japanese Patent Application Publication Open to Public Inspection (hereafter referred to as JP-A) No. 5-45929

Patent Document 2: JP-A No. 5-44027

Patent Document 3: JP-A No. 2006-18018

SUMMARY OF THE INVENTION

An object of the invention is to provide a toner having a superior low temperature fixing ability and being capable of fixing with a high fixing strength regardless of the kind of recording material.

The toner of the invention is a toner containing a binder resin and a colorant and characterized in that the binder resin contains urea-modified polyester constituted by urea bonding a crystalline polyester segment and an amorphous polyester segment by an amine crosslinking agent.

In the invention, the above urea-modified polyester is preferably a block-copolymer constituted by urea bonding an isocyanate-modified amorphous polyester segment and an isocyanate-modified crystalline polyester segment by an amine crosslinking agent.

In the above toner, the crystalline polyester segment is preferably contained in a ratio of 4 to 48% by weight to the whole of the urea-modified polyester.

The toner of the invention, the binder resin has the structure constituted by bonding the amorphous polyester segment, hereinafter referred to as the amorphous polyester component, with the crystalline polyester segment hereinafter referred to as the crystalline polyester component. The amorphous polyester does not have sufficient low temperature fixing ability since it has high viscosity in the melted state but exhibits high anti-offset property and high resistance to storage under high temperature because it has high viscoelasticity at high temperature. On the other hand, the crystalline polyester has sufficient low temperature fixing ability although it has no sufficient anti-offset property since it has low viscosity in melted state. Consequently, superior thermal resistance to storage under high temperature in the airtight or high heat accumulating container can be obtained together with superior anti-hot-offset property, and suitable viscosity in melted state (viscoelasticity) sufficiently corresponding to the low temperature fixing in which, for example, the temperature of the recording material becomes not higher than 100° C. can be obtained. Thus the excellent low temperature fixing ability can be obtained. In the binder resin, the amorphous polyester component and the crystalline polyester component are bonded by urea bonding. Therefore, excessive negative electricity caused by the polyester component is relaxed by the urea bonding so that high affinity of the toner to a negatively chargeable recording material such as the polylactic acid coated paper can be obtained. Moreover, a high affinity to the polylactic acid coated paper can be obtained by the relatively low viscosity in melted state of the crystalline polyester component, even when the polylactic acid coated paper exhibits only a small anchor effect. As a result of that, the fixing with sufficient strength can be carried out so that the peeling off of the laminating material from the toner is only limited when the laminating treatment is applied and the quality of the image can be maintained for a long period.

For example, when printing is performed on a recording material in which moisture content is largely varied such as offset printing paper using dampening water, the curling of the paper is avoided and superior appearance after binding of the paper can be obtained.

Moreover, filming of the toner is prevented so that prolonged life time of a triboelectricity donating member such as a developing roller is obtained. It is presumed to be because: The excessive negative charge of the resin is relaxed by the urea bond because the hydroxyl group (—OH) or carboxyl group (—COOH) being at the terminal of crystalline polyester molecule is urea-bonded with the hydroxyl group (—OH) or carboxyl group (—COOH) being at the terminal of the amorphous polyester molecule by the amine crosslinking agent. As a result of that, the excessive electricity of the toner itself is avoided so that the affinity with the triboelectricity donating member and the fixation (melting adhesion) of the toner onto the triboelectricity donating member is reduced, resulting in preventing the lowering of the function thereof.

DESCRIPTION OF THE PREFERRED EMBODIMENTS

The toner of the invention contains the binder resin and the colorant, and the binder resin contains urea-modified polyester composed of crystalline polyester component and amorphous polyester component which are urea-bonded by the amine crosslinking agent. In a concrete embodiment, for example, it is preferable that the urea-modified polyester constituting the binder resin is a block-copolymer of isocyanate-modified amorphous polyester, hereinafter referred to as isocyanate-modified amorphous polyester component, and isocyanate-modified crystalline polyester, hereinafter referred to as isocyanate-modified crystalline polyester component urea-bonded with each other by the amine crosslinking agent.

The toner containing the binder resin comprising the block-copolymer composed of the isocyanate-modified amorphous polyester component and the isocyanate-modified crystalline polyester component urea-bonded with each other by the amine crosslinking agent is described in detail below.

[Isocyanate-modified Crystalline Polyester Component]

The isocyanate-modified crystalline polyester component constituting the urea-modified polyester as the binder resin is formed by isocyanate modifying crystalline polyester by reacting a crystalline polyester with a polyvalent isocyanate compound, namely a crystalline polyester in which the hydroxyl group or carboxyl group at the molecular terminal thereof is replaced with an isocyanate group capable of reacting with a reactive hydrogen containing group.

The crystalline polyester is a polyester having a melting point (Tm) within a specified temperature range and formed by polycondensation of an aliphatic diol (OH—$R^1$—OH) and an aliphatic dicarboxylic acid (HOOC—$R^2$—COOH), which has simple molecular structure and high crystallinity and shows sharp melting property.

The hydrocarbon group $R^1$ constituting the aliphatic diol and that $R^2$ constituting the aliphatic dicarboxylic acid are each a linear or branched hydrocarbon group having 2 to 12 carbon atoms or a cyclic hydrocarbon group, and an ether bond may be contained in the hydrocarbon group.

The specified temperature range relating to the melting point (Tm) of the crystalline polyester is from 30 to 99° C. and specifically preferably from 45 to 88° C.

The melting point (Tm) of the crystalline polyester is the temperature at the top of endothermic peak which is measured by differential scanning calorimetry using a differential scanning calorimeter DSC-7 and a calorimetry controller TAC 7/DX, each manufactured by PERKINELMER INC.

In concrete, 4.5 mg of the toner was enclosed in an aluminum pan (Kit No. 0219-0041) and set on the sample holder of DSC-7, and then subjected to heat-cool-heat temperature control in a measuring temperature range of from 0 to 200° C., a heating rate of 10° C./minute and a cooling rate of 10° C./minute. The analysis was carried out according to the data at the second heating. An empty aluminum pan was used for a reference.

When no endothermic peak is obtained by DSC measurement of urea-modified polyester, the melting point (Tm) of the crystalline polyester can be determined by isolating the isocyanate-modified crystalline polyester component from the urea-modified polyester and carrying out the DSC measurement on the isolated component. The isocyanate-modified polyester component can be isolated by hydrolyzing the urea-modified polyester by heating for 6 hours together with a strong acid such as concentrated hydrochloric acid.

Tetrahydrofuran (THF) soluble component of the crystalline polyester to be used for the toner of the invention preferably has a number average molecular weight (Mn) of from 100 to 10,000, more preferably from 800 to 5,000, and a weight average molecular weight of from 1,000 to 50,000, and more preferably from 2,000 to 30,000, which are measured by gel permeation chromatography (GPC).

The measurement of the molecular weight by GCP is carried out as follows. A GCP apparatus HCL-8220, manufactured by Toso Co., Ltd., and columns, TSK Guard Column+ triplet TKS Gel Super HZM-M, manufactured by Toso Co., Ltd., are used, and tetrahydrofuran (THF) as a carrier solvent is flowed at a flowing rate of 0.2 ml/min. while maintaining the column temperature at 40° C. The sample to be measured is dissolved in tetrahydrofuran in a concentration of 1 mg/ml by an ultrasonic dispersing machine for five minutes at room temperature and filtered through a membrane filter having a pore size of 0.2 μm to obtain a sample solution. Ten micro liter of the resultant sample solution is injected into the measuring apparatus together with the carrier solvent and detected by a refractive index detector ($R^1$ detector). The molecular weight distribution of the sample is calculated according to a calibration curve prepared by using monodisperse polystyrene standard particles. As the standard polystyrene samples for preparing the calibration curve, ones each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, each manufactured by Pressure Chemical Co., Ltd., are used, and at least 10 kinds of the standards samples were subjected to the determination for preparing the calibration curve. A refractive index detector is used as the detector.

As a preferable example of such the isocyanate-modified crystalline polyester, an isocyanate-modified poly(alkylene ester) is cited. Concrete examples include poly(ethylene sebacate), poly(ethylene adipate), poly(hexamethylene sebacate), poly(octamethylene dodecanedioate), poly(hexamethylene-decamethylene sebacate) and polyoxydecamethylene-2-methyl-1,3-propane dodecanedioate, which may be used singly or in combination of two or more kinds of them.

Examples of the aliphatic diol for forming the crystalline polyester as the isocyanate-modified crystalline polyester component include ethylene glycol, diethylene glycol, triethylene glycol, 1,2-propylene glycol, 1,3-propylene glycol, 1,4-butanediol, 1,4-butenediol, neopentylglycol, 1,5-pentane glycol, 1,6-hexane glycol, 1,7-heptane glycol, 1,8-octanediol, 1,9-nonanediol, 1,10-decanediol, 1,4-cyclohexanediol and dipropylene glycol, which may be used singly or in combination of two or more kinds thereof.

In order to adjust the melting point, in addition to such aliphatic diol, aliphatic polyol having trivalent or more may also be used when the isocyanate-modified crystalline polyester component is polymerized. Examples of such an aliphatic polyol include glycerin, trimethylolethane, trimethylol propane, pentaerythritol, sorbitol, phenol novolac, cresol novolac, and alkylene oxide adducts thereof.

The using ratio of the aliphatic polyol having trivalent or more is preferably from 1 to 30% by weight, more preferably from 2 to 30% by weight, based on the total amount of the polyols including the aliphatic diol. When the using ratio of the aliphatic polyol is less than 1% by weight based on the total amount of the aliphatic polyol, effect of controlling the melting point by the polyol cannot be sufficiently obtained. When the using ratio of the aliphatic polyol exceeds 30% by weight of the total amount of the aliphatic polyol including the aliphatic diol, formed polyester is not crystalline.

Examples of the aliphatic dicarboxylic acid for forming the crystalline polyester as the isocyanate-modified crystalline polyester component include oxalic acid, malonic acid, succinic acid, glutaric acid, adipic acid, suberic acid, azelaic acid, sebacic acid, pimelic acid, citraconic acid, maleic acid, fumalic acid, itaconic acid, glutaconic acid, iso-dodecylsuccinic acid, iso-dodecenylsuccinic acid, n-dodecylsuccinic acid, n-dodecenylsuccinic acid, n-octylsuccinic acid, n-octenylsuccinic acid, acid anhydrides thereof and chlorides thereof, which may be used singly or in combination of two or more kinds thereof.

Additionally to the above aliphatic acids, a small amount of polyvalent carboxylic acid such as trimellitic acid, pyromellitic acid, their acid anhydrate and chloride may be used for forming the isocyanate-modified crystalline polyester for controlling the melting point.

The using ratio of the tri- or more-valent carboxylic acid is preferably from 0.1 to 30% by weight, more preferably from 0.2 to 5% by weight, based on the total amount the carboxylic acid including the aliphatic dicarboxylic acid. When the using ratio of the polyvalent carboxylic acid is less than 0.1% by weight based on the total amount including the aliphatic dicarboxylic acid, effect of controlling the melting point by the polyvalent carboxylic acid cannot be sufficiently obtained. When the using ratio of the polyvalent carboxylic acid exceeds 30% by weight of the total amount including the aliphatic dicarboxylic acid, formed polyester is not crystalline.

The using ratio of the aliphatic diol to the amount of the aliphatic dicarboxylic acid is preferably from 1.5/1 to 1/1.5, and more preferably from 1.2/1 to 1/1.2 in a mole ratio of [OH]/[COOH] of the hydroxyl group [OH] of the aliphatic diol to the carboxylic group [COOH] of the aliphatic dicarboxylic acid.

The isocyanate-modified crystalline polyester having desired molecular weight can be surely obtained when the ratio of the aliphatic diol to the aliphatic dicarboxylic acid is within the above range.

As the polyvalent isocyanate compound to be used for isocyanate-modifying the crystalline polyester, an aliphatic polyvalent isocyanate compound such as tetramethylene diisocyanate, hexamethylene diisocyanate and 2,6-diisocyanatemethyl caproate; an alicyclic polyvalent isocyanate compound such as isopholone diisocyanate and cyclohexylmethane diisocyanate; an aromatic diisocyanate such as trilene diisocyanate and diphenylmethane diisocyanate; an aromaliphatic diisocyante such as α,α,α',α'-tetramethylxylene diisocyanate; an isocyanulate, phenol derivatives of such the polyvalent isocyanate compounds; and compounds formed by blocking each of the polyvalent isocyanate compounds by oxime or caprolactum can be cited.

The above compounds may be used singly or in combination of two or more kinds thereof.

[Isocyanate-modified Amorphous Polyester Component]

The isocyanate-modified amorphous polyester component constituting the urea-modified polyester as the binder resin is one formed by isocyanate modifying amorphous polyester by reacting with a polyvalent isocyanate compound, namely amorphous polyester in which the hydroxyl group or carboxyl group at the molecular terminal thereof is replaced with an isocyanate group capable of reacting with a reactive hydrogen containing group.

The amorphous polyester is a polyester other than the above described crystalline polyester, which usually has no melting point (Tm) and has relatively high glass transition temperature (Tg).

The amorphous polyester can be obtained by polycondensation of a polyol and a polyvalent carboxylic acid.

The glass transition temperature (Tg) of the amorphous polyester is preferably from 20 to 90° C., and specifically preferably from 35 to 65° C.

The softening temperature of the amorphous polyester is preferably from 80 to 220° C., and specifically preferably from 80 to 150° C.

The glass transition temperature (Tg) of the amorphous polyester is measured by the differential scanning calorimeter DSC-7 and the calorimetric analysis apparatus controller TAC 7/DX, each manufactured by PERKINELMER INC.

In concrete, 4.50 mg of the toner was enclosed in an aluminum pan (Kit No. 0219-0041) and set on the sample holder of DSC-7, and then subjected to heat-cool-heat temperature control in a measuring temperature range of from 0 to 200° C., a heating rate of 10° C./minute and a cooling rate of 10° C./minute. An empty aluminum pan was used for a reference. Data at the second heating were obtained and the glass transition temperature (Tg) is expressed by the crossing point of the prolongation of the base line before the rising up of the first endothermic peak and the tangent line at the largest slant point between the rising up portion of the first endothermic peak and the summit of the peak. In the course of the first heating, the temperature was maintained at 200° C. for 5 minutes.

The softening temperature is measured as follows. Under a condition of 20° C. and 50% RH, 1.1 g of the toner is put into a Petri dish and evened, and then stood for 12 hours or more. After that, the toner was pressed by a pressure of 3820 kg/cm for 30 seconds by a tabletting machine SSP-10A, manufactured by Shimadzu Seisakusho Co., Ltd., to prepare a tablet of the sample having a diameter of 1 cm. Then the sample tablet was extruded through a hole of cylindrical die (1 mm diameter×1 mm) by a piston having a diameter of 1 cm under conditions of a load of 196 N (20 kgf), an initial temperature of 60° C., a preliminary heating for 300 seconds and a heating rate of 6° C./min. using a flow tester CFT-500D, manufactured by Shimadzu Seisakusho Co., Ltd. The environmental condition was conditioned at 24° C. and 50% of RH. An offset temperature $T_{offset}$ measured by melting temperature measuring method according to temperature raising method with setting the offset value at 5 mm was defined as the softening temperature of the toner.

THF soluble component of the amorphous polyester to be used for the toner of the invention preferably has a number average molecular weight (Mn) of from 2,000 to 10,000, more preferably from 2,500 to 8,000, and a weight average molecular weight (Mw) of from 3,000 to 100,000, and more preferably from 4,000 to 70,000, which are measured by gel permeation chromatography (GPC).

The measurement of the molecular weight by GCP is carried out as follows. A GCP apparatus HCL-8220, manufactured by Toso Co., Ltd., and columns, TSK Guard Column+ triplet TKS Gel Super HZM-M, 3 columns, manufactured by Toso Co., Ltd., are used, and tetrahydrofuran (THF) as a carrier solvent is flowed at a flowing rate of 0.2 ml/min. while maintaining the column temperature at 40° C. The sample to be measured is dissolved in tetrahydrofuran in a concentration of 1 mg/ml by an ultrasonic dispersing machine for five minutes at room temperature and filtered through a membrane filter having a pore size of 0.2 μm to obtain a sample solution. Ten μL of the resultant sample solution is injected into the measuring apparatus together with the carrier solvent and detected by a refractive index detector (RI detector). The molecular weight distribution of the sample is calculated according to a calibration curve prepared by using monodisperse polystyrene standard particles. As the standard polystyrene samples for preparing the calibration curve, those each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, each manufactured by Pressure Chemical Co., Ltd., are used, and at least 10 kinds of the standards samples are subjected to the determination for preparing the calibration curve. A refractive index detector is used as the detector.

As the polyol for forming the amorphous polyester of the isocyanate-modified amorphous polyester component, for example, a bisphenol such as bisphenol A and bisphenol F; and an alkylene oxide adduct of a bisphenol such as an ethylene oxide adduct thereof and a propylene oxide adduct thereof, can be cited additionally to the foregoing aliphatic diols. As the tri- or more-valent alcohol, glycerol, trimethylopropane, pentaerythlitol and sorbitol are cited. Moreover, cyclohexanedimethanol and neopentyl alcohol are preferably used from the viewpoint of production cost and the environmental suitability. These alcohols can be used singly or in combination of two or more kinds thereof.

As the polyvalent carboxylic acid for forming the amorphous polyester of the isocyanate-modified amorphous polyester component, an aromatic dicarboxylic acid such as phthalic acid, iso-phthalic acid, terephthalic acid and naphthalene dicarboxylic acid additionally to the foregoing aliphatic dicarboxylic acids are cited. Moreover, a tri- or more-valent carboxylic acid such as trimellitic acid and pyromellitic acid may be used for suitably controlling the viscosity in state of the urea-modified polyester.

These carboxylic acids can be used singly or in combination of two or more kinds thereof.

As the poly-valent isocyanate compound for isocyanate-modifying the amorphous polyester, those to be used for isocyanate-modifying the foregoing crystalline polyester are usable.

[Urea-modified Polyester]

The urea-modified polyester to be used for the binder resin of the toner of the invention is obtained by urea-bonding the isocyanate-modified amorphous polyester component with the isocyanate-modified crystalline polyester component. The ratio of the isocyanate-modified crystalline polyester component based on the total weight of the urea-modified polyester is preferably from 4 to 48% by weight, and more preferably from 5 to 30% by weight.

It can be confirmed that the amorphous polyester and the crystalline polyester are chemically bonded with together in the urea-modified polyester constituting the toner of the invention by measurement of H-NMR, $C^{13}$-NMR and thermal decomposition GC/MS, and measurement of thermal decomposition GC/MS of urea-modified polyester after hydrolysis of the by concentrated hydrochloric acid.

Examples of the poly-valent amine include a diamine, for example, an aromatic diamine such as phenylenediamine, diethyltoluenediamine, 4,4'-diaminodiphenylmethane, an alicyclic diamine such as 4,4'-diamino-3,3'-dimethyl-dicyclohexylmethane, diaminecyclohexane and isopholonediamine, and an aliphatic diamine such as ethylenediamine, tetramethylenediamine and hexamethylenediamine; a tri- or more-valent amine such as diethylenetriamine and triethylenetetramine; an amino alcohol such as ethanolamine and hydroxyethylaniline; an aminomercaptane such as aminoethylmercaptane and aminopropylmercaptane; an aminoic acid such as aminopropionic acid and aminocapronic acid; a ketoimine compound formed by blocking the amino group of the above aminoic acid by reaction with a ketone such as acetone, methyl ethyl ketone and methyl iso-butyl ketone; and an amino-blocked compound such as oxasolyzone compound. These compounds can be used singly or in combination of two or more kinds thereof.

In the invention, diamine compounds are preferably used as the poly-valent amine. However, the diamine compound and a small amount of the tri- or more-valent amine may be mixedly used for suitably controlling the viscosity of the urea-modified polyester in melted state, because there is the possible that the toner cannot be highly uniformly charged when unreacted amino terminals remain in the resultant urea-modified polyester.

The weight average molecular weight of the urea-modified polyester is preferably from 5,000 to 500,000 and more preferably from 10,000 to 100,000, and the number average molecular weight of that is preferably from 3,500 to 400,000 and more preferably from 7,000 to 80,000. Sufficient low temperature fixing ability and high adhesion ability to the recording material by the urea-modification of the crystalline polyester and the amorphous polyester can be obtained, and the crushing of the toner in the developing apparatus is inhibited and the strength of resultant image can be raised when molecular weight of the urea-modified polyester is within the above range.

When the molecular weight of the urea-modified polyester is too low, the viscosity in melted state is lowered and the strength of the toner particle itself is lowered some degree so that the possibility is posed that toner particle tends to be crushed by stress in the developing apparatus and the strength of the fixed image is lowered even though the sufficient low temperature fixing ability can be obtained. When the molecular weight of the urea-modified polyester is excessively high, the viscosity in melted state is made higher and the adhesion strength onto the recording material tends to be insufficient.

The molecular weight of the urea-modified polyester can be measured by gel permeation chromatography (GPC) of the THF soluble component. A GCP apparatus HCL-8220, manufactured by Toso Co., Ltd., and columns, TSK Guard Column+triplet TKS Gel Super HZM-M, 3 columns, manufactured by Toso Co., Ltd., are used, and tetrahydrofuran (THF) as a carrier solvent is flowed at a flowing rate of 0.2 ml/min. while maintaining the column temperature at 40° C. The sample to be measured is dissolved in tetrahydrofuran in a concentration of 1 mg/ml by an ultrasonic dispersing machine for five minutes at room temperature and filtered through a membrane filter having a pore size of 0.2 μm to obtain a sample solution. Ten micro liter of the resultant sample solution is injected into the measuring apparatus together with the carrier solvent and detected by a refractive index detector (RI detector). The molecular weight distribution of the sample is calculated according to a calibration curve prepared by using monodisperse polystyrene standard particles. As the standard polystyrene samples for preparing the calibration curve, ones each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, each manufactured by Pressure Chemical Co., Ltd., are used, and at least 10 kinds of the standards samples are subjected to the determination for preparing the calibration curve. A refractive index detector is used as the detector.

The acid value of the urea-modified polyester to be used as the binder resin of the toner of the invention is preferably from 5 to 45 mg KOH/g and more preferably from 5 to 30 mg KOH/g. When the acid value of the urea-modified polyester is too high, the image formation under high temperature-high humidity condition or low temperature-low humidity condition is easily influenced by the environmental condition and possibility of deterioration of image is caused.

The binder resin of the invention preferably has a glass transition temperature (Tg) of from 30 to 60° C., particularly from 35 to 54° C. and a softening temperature of from 70 to 110° C., particularly from 80 to 100° C.

The glass transition temperature and the softening temperature are each measured by the foregoing methods.

<Production Method of Toner>

An example of producing method of such the toner is composed of the following processes: (1-A) a isocyanate-modified crystalline polyester synthesizing process in which the crystalline polyester is synthesized and iso-cyanate modified to prepare the isocyanate-modified crystalline polyester segment, (1-B) a isocyanate-modified amorphous polyester synthesizing process in which the amorphous polyester is synthesized and iso-cyanate modified to produce the isocyanate amorphous polyester segment, (2) process for preparing a raw material liquid for producing the toner, in which a binder resin constituting component composed of the isocyanate-modified crystalline polyester, the isocyanate-modified amorphous polyester, a colorant, and, according to necessity, wax and a charge controlling agent are dissolved or dispersed in an organic solvent, (3) a colored particle producing process in which the colored particles containing the colorant and, according to necessity, the wax and charge controlling agent are produced by forming the urea-modified polyester by crosslinking treatment using the amine crosslinking agent, (4) a shape controlling process for controlling the shape of the obtained colored particles, (5) filtering and washing process for filtering the colored particles from the aqueous medium and washing for removing the surfactant from the particles, (6) a drying process for drying the colored particles, and (7) an external additive adding process for obtaining the toner particles by adding an external additive to the dried colored particles.

(1-A) Isocyanate-modified Crystalline Polyester Synthesizing Process

The isocyanate-modified crystalline polyester synthesizing process is a process for synthesizing the isocyanate-modified crystalline polyester segment using the aliphatic diol and the aliphatic dicarboxylic acid for constituting the urea-modified polyester to be the material of the resin constituting the toner particles.

In concrete, an aliphatic diol and an aliphatic dicarboxylic acid are heated at a temperature of from 150 to 280° C. in the presence of a catalyst such as tetrabutoxy titanate or dibutyl tin oxide and formed water is distilled off, under reduced pressure if it is necessary, to produced crystalline polyester having a hydroxyl group and/or a carboxyl group. And then the poly-valent isocyanate compound is reacted to the polyester at a temperature of from 40 to 280° C. for substituting the hydroxyl group and/or carboxyl group at the terminal of the polyester molecule by the isocyanate group to obtain the isocyanate-modified crystalline polyester segment. On the occasion of the reacting the poly-valent isocyanate compound, a solvent inactive to the poly-valent isocyanate compound, for example, a ketone such as acetone, methyl ethyl ketone and methyl iso-butyl ketone; an ester such as ethyl acetate, an amide such as dimethylformamide and dimethylacetoamide; an ether such as tetrahydrofuran; and an aromatic solvent such as toluene and xylene, may be used according to necessity.

(1-B) Isocyanate-modified Amorphous Polyester Synthesizing Process

The isocyanate-modified amorphous polyester synthesizing process is a process for synthesizing the isocyanate-modified amorphous polyester segment using the aliphatic diol and the aliphatic dicarboxylic acid for constituting the urea-modified polyester to be the material of the resin constituting the toner particles.

In concrete, the isocyanate-modified amorphous polyester segment can be obtained from the poly-valent diol and the poly-valent dicarboxylic acid to form the amorphous polyester in a manner similar to that in the foregoing synthesizing process of the isocyanate-modified crystalline polyester.

(2) Preparation Process of Material Liquid for Producing Toner

The preparation process of material liquid for producing toner is a process for preparing a material liquid for producing the toner by dissolving or dispersing the binder resin constituting component composed of isocyanate-modified crystalline polyester, the isocyanate-modified amorphous polyester and the amine crosslinking agent, and the toner constituting component containing the colorant and, according to necessity, wax and charge controlling agent, in an organic solvent. A catalyst such as dibutyl tin laurate and dioctyl tin laurate may be added into the former forming material liquid.

As the organic solvent to be used for preparing the toner forming material liquid, one having low boiling point and low solubility in water is preferable from the viewpoint of that the solvent can be easily removed after formation of the colored particles. In concrete, for example, methyl acetate, ethyl acetate, methyl ethyl ketone, methyl iso-butyl ketone, toluene and xylene can be cited. These solvents may be used singly or in combination of two or more kinds thereof.

The using amount of the organic solvent is usually from 1 to 300, preferably from 1 to 100, and more preferably from 25 to 70, parts by weight to 100 parts by weight of the binder resin constituting component.

The colorant for constituting the toner of the invention is not specifically limited and carbon black, a magnetic substance, a dye and a pigment are optionally usable. As the carbon black, channel black, furnace black, acetylene black, thermal black and lamp black are usable. As the magnetic substance, a ferromagnetic metal such as iron, nickel and cobalt, an ally containing such the metal, a compound of ferromagnetic metal such as ferrite and magnetite, an alloy displaying ferromagnetism by heating treatment even though containing no ferromagnetic metal such as an alloy so called as Heusler's alloy, for example, a manganese-copper-aluminum alloy and a manganese-copper-tin alloy, and chromium dioxide are usable.

As the dye, C. I. SOLVENT RED 1, 49, 52, 58, 63, 111 and 122, C. I. SOLVENT YELLOW 19, 44, 77, 79, 81, 82, 93, 98, 103, 104, 112 and 162, and C. I. SOLVENT BLUE 25, 36, 60, 70, 93 and 95, are usable. A mixture of them also can be used. As the pigment, C. I. PIGMENT RED 5,48:1, 53:1, 57:1, 122, 139, 144, 149, 166, 177, 178 and 222, C. I. PIGMENT ORANGE 31 and 43, C. I. PIGMENT YELLOW 14, 17, 74, 93, 94, 138, 155, 180 and 185, C. I. PIGMENT GREEN 7 and C. I. PIGMENT BLUE 15:3 and 60, are usable. A mixture of them also can be used.

Various kinds of known wax can be used without any specific limitation. For example, a hydrocarbon type wax such as low molecular weight polyethylene wax, low molecular weight polypropylene wax, Fischertropush wax, microcrystalline wax and paraffin wax, and an ester type wax such as carnauba wax, pentaerythlitol behenate and behenyl citrate can be cited. These waxes may be used singly or in combination of two or more kinds of them.

Various kinds of known charge controlling agent can be used without any limitation. Concretely, nigrosine type dye, a metal salt of naphthenic acid or a higher fatty acid, an alkoxylized amine, a quaternary ammonium chloride, an azo type metal complex, a metal salicylate and a metal complex thereof are usable.

Content of the colorant in the toner constituting material liquid is from 1 to 15%, and preferably from 4 to 10%, by weight of the whole solid ingredients in the toner constituting material liquid.

When the toner constituting material liquid contains the wax, content of the wax is, for example, from 2 to 20%, and preferably from 3 to 18%, by weight of the whole solid ingredients in the toner constituting liquid. When the toner constituting material liquid contains the charge controlling agent, content of the charge controlling agent is, for example, from 0.1 to 2.5%, and preferably from 0.5 to 2.0%, by weight of the whole solid ingredients of the toner constituting material liquid.

(3) Producing Process of Colored Particle

In this process, the above prepared toner constituting material liquid is added and dispersed in an aqueous medium to form oil droplets which are controlled in the particle sized. In the droplet, the isocyanate group of the isocyanate-modified amorphous polyester and the isocyanate of the isocyanate-modified crystalline polyester are crosslinked by the amine crosslinking agent to form a urea-bond so that the urea-modified polyester composed of a block copolymer of the isocyanate-modified crystalline polyester segment and the isocyanate-modified amorphous polyester segment which are bonded with together by urea-bonding is formed for obtaining the colored particles comprising the binder resin in which the colorant and, according to necessity, the wax are contained. And then the organic solvent is removed after completion of the crosslinking reaction.

In the above-described (2) toner constituting material liquid preparation process and (3) colored particle producing process, the amine crosslinking agent is previously added into the droplet of toner constituting material liquid in the aqueous medium. However, another method can be applied, in which the amine crosslinking agent is added into the aqueous medium after formation of droplets by dispersing the toner constituting material liquid containing no amine crosslinking agent in the aqueous medium. In such the case, the urea-modified polyester composed of the block copolymer of the isocyanate-modified amorphous polyester segment and the isocyanate-modified crystalline polyester segment which are bonded together with by urea-bonding is formed in the droplet by crosslinking the isocyanate group of the isocyanate-modified amorphous polyester with the isocyanate group of the isocyanate-modified crystalline polyester by the amine crosslinking agent for forming the urea-bond which is supplied to the droplet from the aqueous medium.

Emulsification of the toner constituting material liquid can be carried out by applying mechanical energy. As the dispersing machine for the emulsification, a low speed sharing dispersing machine, a high speed sharing dispersing machine, a frictional dispersing machine, a high pressure jet dispersing machine and an ultrasonic dispersing machine are applicable without any specific limitation. In concrete, KT model Homomixer, manufactured by Tokushu Kika Kogyo Co., Ltd., can be cited.

The number average primary particle diameter of the droplets in the dispersed state is preferably from 60 to 1,000 nm, and more preferably from 80 to 500 nm.

The "aqueous medium" is defined as a medium containing water in a ratio of not less than 50% by weight. As the component other than water, a water-soluble organic solvent such as methanol, ethanol, iso-propanol, butanol, acetone, methyl ethyl ketone, dimethylformamide, methyl cellosolve, and tetrahydrofuran is usable. Among them, an alcohol type organic solvent capable of not dissolving the resin such as methanol, ethanol, iso-propanol and butanol is preferably used.

The using amount of the aqueous medium is preferably from 50 to 2,000, and more preferably from 100 to 1,000, parts by weight to 100 parts by weight of the toner constituting material liquid.

The toner constituting material liquid can be dispersed and emulsified into the droplets having the desirable particle diameter in the aqueous medium when the adding amount is within the above ratio.

A dispersion stabilizing agent is dissolved in the aqueous medium. Moreover, a surfactant and a resin fine particle may be added into the aqueous medium.

As the dispersion stabilizing agent, an inorganic compound such as tricalcium phosphate, calcium carbonate, titanium oxide, colloidal silica and hydroxyapatite is usable. One soluble by an acid or an alkali such as tri calcium phosphate is preferably used since it is necessary to remove the dispersion stabilizing agent from the colored particles, and one decomposable by enzyme is preferably used from the viewpoint of environment protection.

Examples of the usable surfactant include an anionic surfactant such as an alkylbenzenesulfonate, an α-olefinsulfonate and a phosphate, an amine type salt such as an alkylamine salt, an amino alcohol aliphatic acid derivative, a polyamine aliphatic acid derivative and imidazoline, a quaternary ammonium salt type cationic surfactant such as an alkyltrimethylammonium salt, a dialkyldimethylammonium salt, an alkyldimethylbenzylammonium salt, a pyridinium salt, an alkylisoquinolinium salt and benzedonium chloride, a nonionic surfactant such as a polyol derivative, and an amphoteric surfactant such as alanine, dodecyl-di(aminoethyl)glycine, di(octylaminoethyl)glycine, and N-alkyl-N,N-dimethyl-ammonium betaine. An anionic and cationic surfactant each having a fluoroalkyl group are also usable.

As the resin fine particle for raising dispersion stability, one having a particle diameter of from 0.3 to 3 μm is preferable. Concretely, poly(methyl acrylate) fine particle having a particle diameter of 1 μm and that having a diameter of 3 μm, polystyrene fine particle having a particle diameter of 0.5 μm and that having a particle diameter of 2 μm, and poly(styrene-acrylonitrile) fine particle are cited.

The crosslinking reaction time by the amine crosslinking agent is preferably, for example, from 1 to 24 hours, and more preferably from 2 to 15 hours though the time is varied depending on the kind of the raw material and the kind of the amine crosslinking agent. The reaction temperature is preferably from 20 to 100° C. and more preferably from 50 to 98° C.

The organic solvent removing treatment after completion of the crosslinking reaction is carried out by the operation in which the dispersion composed of the aqueous medium and the colored particles dispersed in the medium is gradually heated while entirely stirred in a laminar flowing state and strongly stirred at a certain temperature range, and then subjected to a de-solvent treatment.

When the colored particles are formed by using the dispersion stabilizing agent, an acid or alkali is added for removing the dispersion stabilizing agent additionally to the organic solvent removing treatment.

(4) Particle Shape Controlling Process

The shape controlling process is a process in which the shape of the colored particles is controlled by a filter passing treatment using a filter having pores of micron order size or a stirring treatment by an annular type continuous stirring mill so that the ratio of the major axis to the minor axis of the particle is within a designated range. As the concrete method for controlling the shape of the colored particle, for example, a method in which the dispersion is passed through a gap, a filter of a fine pore and a method by applying high speed rotation for applying centrifugal force to the colored particles for controlling the shape thereof are applicable. As the concrete apparatus for colored particle shape controlling, a piston type high pressure homogenizer and an in-line screw pump are cited additionally the above annular type continuous stirring mill.

The toner particles having the designated shape can be realized by controlling the time, temperature and speed of the treatment.

The colored particles having the designated major/minor axis ratio can be produced by carrying out the shape controlling treatment as above. The organic solvent removing treatment carried after the crosslinking reaction in the urea-modified polyester producing process may be performed after the shape controlling treatment.

(5) Filtering and Washing Processes

In the filtering and washing processes, a filtering treatment in which the colored particle dispersion obtained by the shape controlling process is cooled and subjected to a filtering treatment for taking out the colored particles from the resultant cooled dispersion by solid-liquid separation, and a washing treatment in which adhering substance such as the surfactant is removed from the filtered colored particles (a cake-shaped lump) are performed. As the concrete method for solid-liquid separation and washing, a centrifugal method, a vacuum filtration method using a Nutsche funnel and a filtering method using a filter press are applicable though the method is not specifically limited.

(6) Drying Process

In the drying process, the washed colored particles are subjected to a drying treatment. For the drying treatment, a spray dryer, a vacuum freezing dryer, a vacuum dryer, a standing rack dryer, a mobile rack dryer, a fluid layer dryer, a rotary dryer and a stirring dryer are applicable though the dryer is not specifically limited. The moisture content of colored particles after the drying treatment is preferably not more than 5%, and more preferably not more than 2%, by weight.

The measurement of the moisture content is carried out by Karl-Fischer coulometric titration. In concrete, an automatic thermal evaporation moisture measuring system AQS 724, manufactured by Hiranuma Sangyo Co., Ltd., composed of an aquameter AO-6, AQI-601 (inter face for AQ-6) and a thermal evaporation apparatus LE-24S was used. Zero point five grams of colored particle after standing for 24 hours in an environment of 20 0C. and 50% RH is exactly weighed and put into a 20 ml sample tube and the tube is closely stopped using a silicone rubber packing coated with TEFLON®, and then the moisture in the closely stopped environment is measured applying the following measuring condition and reagent. Furthermore, two empty samples are measured at the same time for calibrating the moisture in the closely stopped environment.

Sample temperature: 110°C.

Sample heating time: 1 minute

Nitrogen gas flowing rate: 150 ml/minute

Counter electrode liquid (cathode liquid): HYDRANAL®COULOMAT CG-K

Generation liquid (anode liquid): HYDRANAL® COULOMAT AK

When the dried colored particles form an aggregation by weak inter-particle attractive force, the aggregation may be subjected to a loosening treatment. As the loosening apparatus, a mechanical crushing machine such as a jet mill, a HENSCHEL MIXER™ mixer, a coffee mill and a food processor are applicable.

(7) External Additive Adding Process

In this process, external additives such as the charge controlling agent, various kinds of inorganic particle, organic particle and slipping agent are added to the dried colored particle for improving the fluidity, charging ability and cleaning ability to produce the toner. As the apparatus for adding the external additive, various kinds of known mixing apparatus such as a tabular mixer, HENSCHEL MIXER™ mixer, a NAUTOR mixer and a V-type mixer are applicable.

As the inorganic fine particle, powder of an inorganic oxide compound such as silica, titania and alumina is preferable and the inorganic particles is preferably subjected to hydrophobilizing treatment by silane coupling agent or titan coupling agent.

The adding amount of the external additive is from 0.1 to 5.0%, and preferably from 0.5 to 4.0%, by weight of the toner. The external additive may be a combination of various materials.

[Particle Diameter of Toner]

The toner of the invention preferably has a volume median diameter of from 3 to 8 μm. The diameter of the toner particle can be controlled by the concentration of the coagulation agent and the added amount of the organic solvent in the coagulation process, fusing time, and the composition of the polyester resin.

When the volume median diameter is within the range of from 3 to 8 μm, the toner particles having high adherence which fly and adhere onto the heated parts and cause offset at fixing process are reduced and the transferring efficiency of toner is increased so that the qualities of halftone images, fine lines and dots are improved.

The particle diameter distribution of the toner is preferably from 16 to 35, and more preferably from 18 to 22, in CV value.

The CV value can be obtained according to the following Expression X.

$$CV\ \text{value}(\%)=\{(\text{Standard deviation})/(\text{Arithmetic average of particle diameter})\}\times 100 \qquad \text{Expression X}$$

The arithmetic average of particle diameter is an average value of volume based particle diameter x measured for 25,000 toner particles using COULTER MULTISIZER™ III manufactured by BECKMAN COULTER Inc.

The volume median diameter of the toner is measured and calculated by using COULTER MULTISIZER™ III and a computer system for data processing, each manufactured by BECKMAN COULTER Inc.

In concrete, 0.02 g of the toner is added to 20 ml of a surfactant solution for dispersing the toner, for example, a solution prepared by diluting a neutral detergent by 10 times by purified water, and wetted and then subjected to ultrasonic dispersion for 1 minute to prepare a toner dispersion. The toner dispersion is injected into a beaker set on the sample stand, in which an electrolyte solution ISOTON® II, manufactured by BECKMAN COULTER Inc., is contained, until the density indicated by the measuring apparatus becomes 5 to 10%. Measured values with high reproducibility can be obtained by making the density into such the range. The frequency is calculated by separating into 256 area the range of from 1 to 30 μm under conditions of a count number of the measuring particles of 25,000 and an aperture diameter of 50 μm, and the particle diameter at a point of 50% from the larger side of the volume accumulation ratio (volume D 50% diameter) is defined as the volume median diameter.

[Average Circularity of Toner Particle]

Each of the toner particles constituting the toner of the invention preferably has an average circularity of from 0.930 to 1.000 and more preferably from 0.950 to 0.995.

When the average circularity is within the range of from 0.950 to 0.995, the filling density of the toner particles in the toner layer transferred onto the recording material and fixing suitability are improved so that the fixing offset is difficultly caused. Moreover, the toner particles are difficultly crushed so that the contamination of the triboelectricity donating member is reduced and the charging of the toner particles is stabilized.

The average circularity of the toner particles is a value measured by FPIA-2100, manufactured by SYSMEX Corp. In concrete, the toner was wetted by an aqueous solution containing a surfactant and dispersed therein by ultrasonic wave for 1 minute, and then the toner particles are photographed in a suitable density by FPIA-2100, manufactured by SYSMEX Corp. under conditions of HPF (high magnitude photographing) mode and a HPF detecting number of from 3,000 to 10,000. The circularity of each of toner particles is individually calculated according to the following Expression Y. The average circularity is obtained by wholly adding the circularities of the measured toner particles and dividing by the total number of the measured toner particles.

$$\text{Circularity}=(\text{Circumference length of a circle the same as that of the particle image in the projection area})/(\text{Circumference length of the projection image of particle}) \qquad \text{Expression Y}$$

<Developer>

As to the toner of the invention, the use for a single-component magnetic toner by containing a magnetic substance, that for a double-component developer by mixing with a carrier and that for a non-magnetic toner by single use can be considered. The toner can be suitably applied for any of the above uses.

In the case that the toner is used as the double-component developer by mixing with the carrier particles, occurrence of filming on the carrier particles (carrier contamination) can be inhibited and in the case of the single-component developer, occurrence of the toner filming on the triboelectricity donating member can be inhibited.

As the carrier for constituting the double-component developer, known materials, for example, a metal such as iron, ferrite and magnetite, an alloy of aluminum or lead with the above metal can be used and ferrite is preferably used.

The carrier preferably has a volume average particle diameter of from 15 to 100 μm and more preferably from 25 to 60 μm. The volume average particle diameter of the carrier can be measured by typically a laser diffraction particle diameter measuring apparatus having a wet type dispersing apparatus HELOS, manufactured by SYMPATEC Co.

As the carrier, a resin coated carrier or a rein dispersion type carrier in which magnetic particles are dispersed in rein are preferably used. For the coating resin, for example, an olefin type resin, a styrene type resin, a styrene-acryl type resin, a silicone resin, an ester type resin and a fluororesin are usable though the resin is not specifically limited. Known resins such as a styrene-acryl type resin, a polyester type resin, a fluororesin and a phenol type resin can be used as the resin for constituting the resin dispersion type carrier without any limitation.

<Image Forming Method>

The above toners can be suitably used for an image forming method including a fixing process by contact heating method. In the image forming the method, for example, an electrostatic image formed on an image carrier is developed to form a toner image using the above developer charged by a triboelectricity donating member in a developing apparatus, and the developed image is transferred onto the recording material. The transferred material is fixed on the recording material by the fixing treatment by contact heating method to form a visible image.

<Fixing Method>

As the suitable fixing method for using the toner of the invention, a method so called as contact heating system is applicable. The contact heating system include a heat-fixing method, a heating roller system or a contact heating fixing system using a rotatable pressing member including a fixedly arranged heater.

In the fixing method using the heating roller fixing system, a fixing apparatus is usually used which is composed of an upper roller of a cylinder of metal such as iron and aluminum covered by fluororesin and a heat source is provided interior of the roller and a lower roller formed by silicone rubber.

A line-shaped heater is used as the heat source and the surface of the upper roller is heated by a temperature from 120 to 200° C. by the heater. Pressure is applied between the upper and the lower rollers and the lower roller is deformed by the pressure so as to form a nip is formed at the deformed portion. The width of the nip is from 1 to 10 mm and preferably from 1.5 to 7 mm. The line speed of fixation is preferably from 40 mm/sec. to 600 mm/sec. When the nip width is too small, heat cannot be uniformly applied to the toner so that the ununiform fixation tends to be caused. When the nip width is too large, melting of the polyester is accelerated so that fixing offset tends to be caused.

The embodiments of the invention are described above, but the invention is not limited to the above embodiments and various variations may be added.

For example, the production method of the toner relating to the invention is not limited to the above-described method and a method may be applied in which, for example, a melted and kneaded material of the binder resin composed of the urea-modified polyester and the colorant is extruded through a die to form a rod and the rod-shaped material is crashed to form the toner particles.

EXAMPLES

Examples carried out for confirming the effects of the invention are described below, but the invention is not limited thereto.

Synthesizing Example of Isocyanate-modified Crystalline Polyester 1

First, 1,500 parts by weight of sebacic acid, 964 parts by weight of hexamethylene glycol and 2 parts by weight of dibutyl tin oxide were put into a 5 L round bottom flask as a reaction container on which a thermometer, a stirrer, a nitrogen gas introducing tube and a falling type condenser were attached. Then the reaction container was set on a mantle heater and heated to 150° C. under nitrogen gas atmosphere. After that, 13.2 parts by weight of p-toluenesulfonic acid was added and reacted. The reaction was stopped at a time when the distillated out water formed by the reaction was amounted to 250 parts by weight and the reaction system was cooled to room temperature. Thus Crystalline Polyester [a1] composed of poly(hexamethylene sebacate) was obtained. Crystalline Polyester [a1] had a melting point (Tm) of 64° C., a weight average molecular weight (Mw) measured by GPC of 3,500 and a number average molecular weight (Mn) of 2,000.

In a reaction vessel on which a stirrer and a nitrogen introducing tube were attached, 2,000 parts by weight of ethyl acetate, 1,000 parts by weight of Crystalline Polyester [a1] was charged and heated to 80° C., and then 188 parts by weight of isopholone diisocyanate was added and reacted for 2 hours to obtain Isocyanate-modified Crystalline Polyester [A1].

Synthesizing Example of Isocyanate-modified Crystalline Polyester 2

In a four necked flask on which a nitrogen introducing tube, a dehydrating pipe and a stirrer were attached, 2,253 parts by weight of 1,4-butanediol, 3,063 parts by weight of fumalic acid, 5.3 parts by weight of hydroquinone and 2 parts by weight of dibutyl tin oxide were reacted for 5 hours at 150° C. After that, the temperature was raised to 200° C. and the reaction was continued for 1 hour, and the reaction was further continued for 1 hour at 85 hPa to obtain Crystalline Polyester [a2]. The crystalline polyester had a melting point Tm of 96° C., a weight average molecular weight Mw of 4,500 and a number average molecular weight of 2,900.

Into a reaction vessel on which a stirrer and a nitrogen introducing tube were attached, 2,000 parts by weight of ethyl acetate and 1,000 parts by weight of Crystalline Polyester [a2] were charged and heated to 80° C., and reacted with isopholone dicyanate for 2 hours to obtain Isocyanate-modified Crystalline Polyester [A2].

Synthesizing Example of Isocyanate-modified Amorphous Polyester

Into a reaction vessel on which a stirrer and a nitrogen introducing tube were attached, 724 parts by weight of adduct of bisphenol A with 2 moles of ethyleneoxide, 200 parts by weight of isophthalic acid, 70 parts by weight of fumalic acid and 2 parts by weight of dibutyl tin oxide were charged and reacted for 8 hours at 230° C. under ordinary pressure and further reacted for 5 hours under a reduced pressure of 12 mmHg, and then cooled to 160° C. After that, 32 parts by weight of phthalic anhydride was added and reacted for 2 hours to obtain Amorphous Polyester [b1]. Amorphous Polyester [b1] had a glass transition temperature Tg of 59° C., a softening temperature of 121° C., a number average molecular weight (Mn) of 6,000 and a weight average (Mw) of 28,000.

To 1,000 parts by weight of Amorphous Polyester [b1], 2,000 parts by weight of ethyl acetate and then 100 parts by weight of isopholone diisocyanate and reacted for 2 hours at 80° C. to obtain Isocyanate-modified Amorphous Polyester [B1].

Synthesizing Example of Comparative Binder Resin 1

Into a separable flask, 100 parts by weight of toluene was charged and then 75 parts by weight of styrene, 25 parts by weight of butyl acrylate and 0.2 parts by weight of benzoyl peroxide were added and heated to 80° C. under nitrogen atmosphere, and reacted for 15 hours (the first step polymerization). After that, the content of the flask was cooled to 40° C. and 85 parts by weight styrene, 10 parts by weight of butyl methacrylate, 5 parts by weight of acrylic acid and 4 parts by weight of benzoyl peroxide were added and stirred for 2 hours while holding at 40° C., and then the temperature was raised to 80° C. and maintained for 8 hours for performing the polymerization (the second step polymerization). Furthermore, 0.5 parts by weight of zinc oxide was added as a polyvalent metal compound and the reaction was continued for 2 hours. Thereafter, toluene was distilled out under vacuum to obtain Amorphous Vinyl Polymer [d1].

Twenty parts by weight of Crystalline Polyester [a1], 80 parts by weight of Amorphous Vinyl Polymer [d1], 0.05 parts by weight of p-toluenesulfonic acid and 100 parts by weight of xylene were charged into a separable flask and fluxed for 1 hour at 150° C. and then xylene was distilled out under vacuum to obtain a graft resin as comparative binder resin which was referred to as Comparative Graft Resin [C1]. It was confirmed that Crystalline Polyester [a1] was chemically bonded with Amorphous Vinyl Polymer [d1] by measurement of H-NMR, $C^{13}$-NMR and thermal decomposition GC/MS of Comparative Graft Resin [C1], and measurement of thermal decomposition GC/MS of hydrolysis product of Comparative Graft Resin [C1] by concentrated hydrochloric acid. Comparative Graft Resin [C1] had a weight average molecular weight (Mw) was 165,000, a number average molecular weight (Mn) was 6,370, a glass transition temperature (Tg) of 62° C. and a softening temperature of 130° C.

Synthesis Example of Comparative Binder Resin 2

Thirty five parts by weight of poly(allyl acrylate) having a hydroxyl group at the terminal of the molecule which is polymerized by an initiator of 1-hydroxybutyl peroxide and had a melting point (Tm) of 90° C., a weight average molecular weight (Mw) of 14,000, a number average molecular weight (Mn) of 4,700, and 65 parts by weight of poly(styrene-n-butyl acrylate) having a weight ratio of 85:15 and having hydroxyl group at the terminal of the molecule, a glass transition temperature (Tg) of 63° C., a weight average molecular weight (Mw) of 14,000 and a number average molecular weight (Mn) of 3,500, were coupled by a coupling agent of hexamethylene diisocyanate to obtain a block copolymer as a comparative binder resin, hereinafter referred to as Comparative Block Resin [C2]. It was confirmed in Comparative Block Resin [C2] that the amorphous vinyl polymer was chemically bonded with the crystalline vinyl polymer by measurement of H-NMR, $C^{13}$-NMR and thermal decomposition GC/MS of Comparative Block Resin [C2], and measurement of thermal decomposition GC/MS of hydrolysis product of Comparative Block Resin [C2] by concentrated hydrochloric acid. Comparative block resin [C2] had a weight average molecular weight (Mw) of 62,000 and a number average molecular weight (Mn) of 5,600.

Synthesis Example of Comparative Binder Resin 3

Into a reaction vessel equipped with a stirrer and a nitrogen introducing tube, 724 parts by weight of an adduct of bisphenol A with 2 moles of ethylene oxide, 200 parts by weight of isophthalic acid, 70 parts by weight of fumalic acid and 2 parts by weight of dibutyl tin oxide were charged and reacted for 8 hours at 230° C. under an ambient pressure and further reacted for 5 hours under reduced pressure of 12 mmHg, and cooled to 160° C. Then 32 parts by weight of phthalic anhydride was added and reacted for 2 hours. After that, the system was cooled to 80° C. and 200 parts by weight of styrene, 1 part by weight of benzoyl peroxide and 0.5 parts by weight of dimethylaniline were added and reacted in ethyl acetate for 2 hours and then ethyl acetate was removed to obtain a graft resin as a comparative binder resin, hereinafter referred to as Comparative Graft Resin [C3]. It was confirmed that the polystyrene component was chemically bonded with the amorphous polyester component by measurement of H-NMR, $C^{13}$-NMR and thermal decomposition GC/MS of comparative graft resin [C3], and measurement of thermal decomposition GC/MS of hydrolysis product of Comparative Graft Resin [C3] by concentrated hydrochloric acid. Comparative Graft Resin [C3] had a weight average molecular weight of 92,000.

Synthesizing Example 4 of Comparative Binder Resin

Into a reaction vessel equipped with a stirrer and a nitrogen introducing tube, 724 parts by weight of the adduct of bisphenol A with 2 moles ethylene oxide, 276 parts by weight of isophthalic acid, and 2 parts by weight of dibutyl tin oxide were charged and reacted for 8 hours at 230° C. under an ambient pressure and further reacted for 5 hours under a reduced pressure of 12 mmHg and then cooled to 160° C. Then 32 parts by weight of phthalic anhydride was added and reacted for 2 hours. After that, 188 parts by weight of isopholone diisocyanate was added and reacted for 2 hours in ethyl acetate to obtain an isocyanate-modified amorphous polyester. Then 267 parts by weight of the isocyanate-modified amorphous polyester and 14 parts by weight of isopholonediamine were reacted for 2 hours and ethyl acetate was removed by distillation to obtain Urea-modified Polyester Resin [C4] as a comparative binder resin. The weight average molecular weight of Urea-modified Polyester Resin [C4] was 64,000.

Toner Preparation Example 1

In a mixing vessel attached with a liquid seal (refluxing device) and a stirrer, 450 parts by weight of ethyl acetate, 267 parts by weight of isocyanate-modified amorphous polyester [B1], 37 parts by weight of Isocyanate-modified Crystalline Polyester [A1], 21 parts by weight of isopholonediamine, 4 parts by weight of copper phthalocyanine blue, 4 parts by weight of carbon black, 15 parts by weight of pentaerythritol tetrastearate were mixed for 2 hours at 20° C. to obtain Toner Composition [1].

On the other hand, 600 parts by weight of deionized water, 60 parts by weight of tricalcium phosphate, 0.3 parts by weight of sodium dodecylbenzenesulfonate were charged in another reacting vessel, and the above Toner Composition [1] was poured into the vessel and dispersing in the aqueous medium while stirring by KT type Homomixer, manufactured by Tokushu Kika Kogyo Co., Ltd., for 3 minutes at 12,000 rpm and 30° C. Then the resultant dispersion was heated to 80° C. and subjected to urea reaction treatment for 10 hours.

After that, the Toner Composition [1] after the urea-reaction treatment was transferred to another stirring vessel and stirred after addition of 0.3 parts by weight of sodium dodecylsulfate and 30 parts by weight of 35% concentrated hydrochloric acid, and then the solvent, ethyl acetate, was removed at 30° C. under reduced pressure of 50 mmHg. Moreover, 120 parts by weight of 35% concentrated hydrochloric acid was additionally added for dissolving tricalcium phosphate on the toner surface.

After that, the solid composition was separated from the liquid component and the obtained toner cake was re-dispersed in deionized water and then separated, and such the treatment was repeated for three times for cleaning, and dried for 24 hours at 40 °C. to obtain Toner Particle [1]. One hundred parts by weight of thus obtained Toner Particle [1]was mixed with 0.6 part by weight of hydrophobic silica and 1.0 part by weight of hydrophobic titanium oxide by a HENSCHEL MIXER™ mixer to obtain Toner [1]. The mixing was performed for 20 minutes at the circumference speed of the HENSCHEL MIXER™ mixer of 35 in/sec. and a temperature of 32 °C., and the toner was passed through a sieve of 45 μm. Toner [1] had a volume median diameter of 5.2 μm and an average circularity of 0.964. Toner [1] had a glass transition temperature Tg of 49 °C., a number average molecular weight (Mn) of 10,500, a weight average molecular weight (Mw) of 38,000 and a CV value of particle diameter distribution (hereafter, referred to merely as "CV value") of Toner [1]of 21.

It was confirmed that isocyanate-modified crystalline polyester [A1] was chemically bonded with Isocyanate-modified Amorphous Polyester [B1] by measurement of H-NMR, $C^{13}$-NMR and thermal decomposition GC/MS and measurement of thermal decomposition GC/MS of hydrolysis product of Toner [1] by concentrated hydrochloric acid. It was also confirmed that the content of free crystalline polyester component or free amorphous polyester component is less than 0.5% of whole of the toner.

Toner Preparation Example 2

Toner [2] was obtained in the same manner as in toner preparation example [1] except that Isocyanate-modified Crystalline Polyester [A2] was used in place of Isocyanate-modified Crystalline Polyester [A1]. The volume median diameter and the average circularity of Toner [2] were each 5.3 μm and 0.962, respectively. Toner [2] had a glass transition temperature Tg of 54° C., a softening temperature of 102° C., a number average molecular weight (Mn) of 11,500, a weight average molecular weight (Mw) of 39,000 and a CV value of 21. It was confirmed that isocyanate-modified crystalline polyester [A2] was chemically bonded with isocyanate-modified amorphous polyester [B1]. It was also confirmed that the content of the crystalline polyester component or the amorphous polyester component in the free state is less than 1% of whole of the toner.

Toner Preparation Example 3

Toner [3] was obtained in the same manner as in toner preparation example [1] except that 65 parts by weight of Isocyanate-modified Crystalline Polyester [A1] and 28 parts by weight of isopholonediamine were used. The volume median diameter and the average circularity of Toner [3] were each 5.1 μm and 0.960, respectively. Toner [3] had a glass transition temperature Tg of 47° C., a softening temperature of 95° C., a number average molecular weight (Mn) of 9,500, a weight average molecular weight (Mw) of 33,000 and a CV value of 20. It was confirmed that Isocyanate-modified Crystalline Polyester [A1] was chemically bonded with Isocyanate-modified Amorphous Polyester [B1]. It was also confirmed that the content of free crystalline polyester component or free amorphous polyester component is less than 0.7% of whole of the toner.

Toner Preparation Example 4

Toner [4] was obtained in the same manner as in toner preparation example [1] except that Isocyanate-modified Crystalline Polyester [A2] was used in place of Isocyanate-modified Crystalline Polyester [A1]. The volume median diameter and the average circularity of Toner [4] were each 5.2 μm and 0.961, respectively. Toner [4] had a glass transition temperature Tg of 53° C., a softening temperature of 101° C., a number average molecular weight (Mn) of 9,900, a weight average molecular weight (Mw) of 35,000 and a CV value of 19. It was confirmed that Isocyanate-modified Crystalline Polyester [A2] was chemically bonded with Isocyanate-modified Amorphous Polyester [B1]. It was also confirmed that the content of free crystalline polyester component or free amorphous polyester component in the free state is less than 0.7% of whole of the toner.

Toner Preparation Example 5

Toner [5] was obtained in the same manner as in toner preparation example [1] except that 18 parts by weight of Isocyanate-modified Crystalline Polyester [A1] and 14 parts by weight of isopholonediamine were used. The volume median diameter and the average circularity of Toner [5] were each 5.3 μm and 0.964, respectively. Toner [5] had a glass transition temperature Tg of 56° C., a softening temperature of 111° C., a number average molecular weight (Mn) of 8,200, a weight average molecular weight (Mw) of 29,000 and a CV value of 20. It was confirmed that Isocyanate-modified Crystalline Polyester [A1] was chemically bonded with Isocyanate-modified Amorphous Polyester [B1]. It was also confirmed that the content of free crystalline polyester component or free amorphous polyester component is less than 0.3% of whole of the toner.

Toner Preparation Example 6

Toner [6] was obtained in the same manner as in toner preparation example [5] except that Isocyanate-modified Crystalline Polyester [A2] was used in place of Isocyanate-modified Crystalline Polyester [A1]. The volume median diameter and the average circularity of Toner [6] were each 5.3 μm and 0.963, respectively. Toner [6] had a glass transition temperature Tg of 57° C., a softening temperature of 114° C., a number average molecular weight (Mn) of 8,800, a weight average molecular weight (Mw) of 30,000 and a CV value of 20. It was confirmed that Isocyanate-modified Crystalline Polyester [A2] was chemically bonded with Isocyanate-modified Amorphous Polyester [B1]. It was also confirmed that the content of free crystalline polyester component or free amorphous polyester component in the free state is less than 0.3% of whole of the toner.

Comparative Toner Preparation Example 1

Comparative toner [7] was obtained in the same manner as in toner preparation example [1] except that 325 parts by weight of Comparative Graft Resin [C1] was used in place of Isocyanate-modified Crystalline Polyester [A1], Isocyanate-modified Amorphous Polyester [B1] and isopholonediamine. The volume median diameter and the circularity of Toner [7] were each 5.4 and 0.965, respectively. The CV value of Toner [7] was 23.

Comparative Toner Preparation Example 2

Comparative toner [8] was obtained in the same manner as in toner preparation example [1] except that 325 parts by weight of Comparative Graft Resin [C2] was used in place of Isocyanate-modified Crystalline Polyester [A1], Isocyanate-modified Amorphous Polyester [B1] and isopholonediamine.

The volume median diameter and the circularity of Toner [8] were each 5.2 and 0.963, respectively. The CV value of Toner [8] was 24.

Comparative Toner Preparation Example 3

Comparative toner [9] was obtained in the same manner as in preparation example [1] except that 325 parts by weight of Comparative Graft Resin [C3] was used in place of Isocyanate-modified Crystalline Polyester [A1], Isocyanate-modified Amorphous Polyester [B1] and isopholonediamine. The volume median diameter and the circularity of Toner [9] were each 5.4 and 0.961, respectively. The CV value of Toner [9] was 23.

Comparative Toner Preparation Example 4

Comparative toner [10] was obtained in the same manner as in preparation example [1] except that Isocyanate-modified Crystalline Polyester [A1] was not used and 14 parts by weight of isopholonediamine and Urea-modified Polyester Resin [C4] were used. The volume median diameter and the circularity of Toner [10] were each 5.4 and 0.961, respectively. The CV value of Toner [10] was 24.

Preparation Example of Carrier

Manganese-magnesium ferrite having a weight average diameter of 50 μm was spray coated with a coating liquid composed of 85 parts by weight of silicone resin (oxime curing type, a toluene solution) as the solid component, 10 parts by weight of γ-aminopropyltrimethoxysilane (coupling agent), 3 parts by weight of alumina particles (particle diameter of 100 nm) and 2 parts by weight of carbon black, and baked for 6 hours at 190° C. and then cooled to room temperature to obtain a resin coated carrier. The average thickness of the resin coating layer was 0.2 μm.

Preparation Example of Developer

In a V-type mixer, 94 parts by weight of the above prepared carrier and each of the above prepared Toners [1] to [6] and comparative Toners [7] to [10] were mixed to prepare Developers [1] to [6] and Comparative Developers [7] to [10], respectively. The mixing treatment was stopped at a time when the charging of the toner amounted to 20 to 23 μC/g and taken out into a polyethylene pot.

Examples 1 to 6

Comparative Example 1 to 4

The low temperature fixing suitability, fixing ability on polylactic acid coated recording material and lifetime of the developing roller were evaluated by using each of Developers [1] to [6] and Comparative Developers [7] to [10], or Toners [1] to [6] and Comparative Toners [7] to [10] by the following methods.

<Low Temperature Fixing Ability>

A thermo-indicating tape Digital Thermo Tape D-50, manufactured by Tech-jam Co., Ltd., was previously pasted at four points around the area of 3 cm square, on which an image was to be formed, on ordinary A4-size paper having a weight of 80 g/m$^2$. An image of patch of 3 cm square having a reflective density of 1.4 was printed and developed on the printing area on the above prepared paper by a digital copying machine Bizhub 500, manufactured by Konica Minolta Business Technologies Inc., using each of Developers [1] to [6] and Comparative Developers [7] to [10], and fixed at 120° C. to obtain a test image. Mending Tape, manufactured by Sumitomo Chemical Co., Ltd., of a size of 1.5 cm×3 cm was pasted on the test image and peeled off after 3 seconds and the density of the image was measured by Macbeth Reflective Densitometer RD-918. Such the peeling experiment was repeated while lowering the fixing temperature by every 5° C. such as 115° C., 110° C. . . . until the reflective density decreased less than 1.25. The lowest fixing temperature was evaluated based on the paper temperature in the peeling test just before the reflective density decreased at less than 1.25.

The thermo-indicating tape had a temperature measuring range of from 50 to 100° C., a temperature pitch of 5° C. and an accuracy of ±2° C. on which the temperature was displayed by a liquid crystal display.

<Evaluation of Fixing Ability on Polylactic Acid Coated Paper>

A solid black image was printed on both sides of Peachcoat LR sheet which was coated with plastic polylactic acid latex derived from a plant such as corn and has a size of A3 and a thickness of 110 μm, and subjected to lamination treatment on both sides at 110° C. and a treatment rate of 100 mm/sec. Thus a printed matter on which laminate film of 120 μm was formed was obtained. A sample of 10 cm square size was cut out from the laminated printed matter by a cutter and fallen onto a stone plate having a thickness of 30 cm so that the cut face was made a right angle, and fixing ability was evaluated based on the falling height causing the peeling off between the surface coated with the polylactic acid latex and the solid black image.

Evaluation criteria:

A: Peeling was not caused even when the sample was fallen from a height of 100 cm.

B: Peeling was not more than 1 cm when the sample was fallen from a height of 75 cm.

C: Peeling was not more than 2 cm when the sample was fallen from a height of 50 cm, but acceptable for use as a card.

D: Peeling was caused when the sample was fallen from a height of 30 cm, and practical use as a practical card is difficult.

<Lifetime of Developing Roller>

The lifetime of the developing roller was evaluated by using Toners [1] to [6], Comparative Toners [7] to [10] and a laser printer available on the market: PAGE PRO 1350W, manufactured by KONICA MINOLTA BUSINESS TECHNOLOGIES Inc., with modified cartridge. In concrete, a toner supplying tube was connected to the cartridge so that the toner could be forcibly supplied into the cartridge from a toner hopper provided on outside of the printer in order to evaluate the lifetime of the developing roller without limitation to the volume of the cartridge. The lifetime of the developing roller was evaluated on every 1,000 sheets of the print, based on the occurrence of white line caused by failure in the conveyance of the toner or on detection of a relative density of the contamination in the non-image area of exceeding 0.004. The lifetime of the developing roller was determined by visual confirmation of that the white line and image contamination were caused accompanied with the toner filming on the developing roller.

TABLE 1

| | Toner No. | Low temperature fixing ability (° C.) | Fixing ability on polylactic acid coated paper | Lifetime of developing roller |
|---|---|---|---|---|
| Example 1 | 1 | 80 | A | 8000 sheets |
| Example 2 | 2 | 80 | A | 10000 sheets |
| Example 3 | 3 | 80 | A | 8000 sheets |
| Example 4 | 4 | 80 | A | 8000 sheets |
| Example 5 | 5 | 85 | A | 8000 sheets |

TABLE 1-continued

| | Toner No. | Low temperature fixing ability (° C.) | Fixing ability on polylactic acid coated paper | Lifetime of developing roller |
|---|---|---|---|---|
| Example 6 | 6 | 90 | A | 8000 sheets |
| Comparative example 1 | 7 | 90 | D | 2000 sheets |
| Comparative example 2 | 8 | 90 | D | 2000 sheets |
| Comparative example 3 | 9 | 110 | C | 4000 sheets |
| Comparative example 4 | 10 | 115 | C | 5000 sheets |

As is clean in Table 1, the excellent low temperature fixing ability, fixing ability on the polylactic acid coated paper and long lifetime of developing roller were confirmed for the toners relating to Examples 1 to 6. On the other hand, when the toner composed of the binder resin containing a vinyl polymer, relating to Comparative Example 1 or 2, was used, the fixing ability on the polylactic acid coated paper was low and the lifetime of developing roller was short, although not bad low temperature ability was obtained. Also, when the toner composed of a binder resin containing no crystalline polyester, relating to Comparative Example 3 or 4, was used, the no sufficient low temperature fixing ability was obtained.

What is claimed is:

1. A toner comprising a binder resin and a colorant, wherein the binder resin comprises an urea modified polyester, the urea modified polyester being prepared by urea-bonding an isocyanate-modified crystalline polyester segment and an isocyanate-modified amorphous polyester using an amine crosslinking agent.

2. The toner of claim 1, wherein the urea modified polyester is a block-copolymer prepared by urea-bonding the isocyanate-modified crystalline polyester segment and the isocyanate-modified amorphous polyester using the amine crosslinking agent.

3. The toner of claim 1, wherein a content of the crystalline polyester segment is 4 to 48% by weight based on a total weight of the urea modified polyester.

4. The toner of claim 1, wherein a melting point of the crystalline polyester is 30 to 99° C.

5. The toner of claim 1, wherein a melting point of the crystalline polyester is 45 to 88° C.

6. The toner of claim 1, wherein a number average molecular weight of a tetrahydrofuran soluble component of the crystalline polyester is 100 to 10000, and a weight average molecular weight of the tetrahydrofuran soluble component of the crystalline polyester is 1000 to 50000.

7. The toner of claim 1, wherein a glass transition temperature (Tg) of the amorphous polyester is 20 to 90° C.; and a softening temperature of the amorphous polyester is 80 to 220° C.

8. The toner of claim 1, wherein a number average molecular weight of a tetrahydrofuran soluble component of the amorphous polyester is 2000 to 10000; and a weight average molecular weight of the tetrahydrofuran soluble component of the amorphous polyester is 3000 to 100000.

9. The toner of claim 1, wherein a weight average molecular weight of the urea modified polyester is 5000 to 500000; and a number average molecular weight of the urea modified polyester is 3500 to 400000.

10. The toner of claim 1, wherein a glass transition temperature (Tg) of the urea modified polyester is 30 to 60° C.; and a softening temperature of the urea modified polyester is 70 to 110° C.

* * * * *